United States Patent [19]

Lewis

[11] 3,949,222

[45] Apr. 6, 1976

[54] METHOD AND APPARATUS FOR REDUCING THE DENSITY OF BACKGROUND AREAS WITHOUT AFFECTING THE DENSITY OF PICTURE AREAS IN AN ELECTRORADIOGRAPH

[75] Inventor: John H. Lewis, Los Angeles, Calif.

[73] Assignee: Xonics, Inc., Van Nuys, Calif.

[22] Filed: Nov. 1, 1974

[21] Appl. No.: 519,998

[52] U.S. Cl. ..... 250/315 A

[51] Int. Cl.[2] ..... G03G 15/044

[58] Field of Search..... 250/315 A; 96/1 PE, 1 A, 96/1 C, 1 E; 355/16

[56] References Cited

UNITED STATES PATENTS

| | | | |
|---|---|---|---|
| 3,598,579 | 8/1971 | Robinson | 96/1 |
| 3,774,029 | 11/1973 | Muntz et al. | 250/315 A |
| 3,780,288 | 12/1973 | Dryden | 250/315 A |

*Primary Examiner*—Davis L. Willis

*Attorney, Agent, or Firm*—Harris, Kern, Wallen & Tinsley

[57] ABSTRACT

Apparatus and method for improving an electron radiograph by reducing the charge density in the background area of the electrostatic image and thereby reducing the amount of toner attracted to such areas during developing. The latent electrostatic image is generated by exposure to a radiation source in an imaging chamber and the higher charge densities are then neutralized by exposing the electrostatic image to an ion discharge, with a bias potential for limiting the neutralizing action, after which the electrostatic image is developed into a visual image.

10 Claims, 3 Drawing Figures

RADIATION SOURCE
13
14
16
17
18
19
21
22
10
IMAGING CHAMBER
RECEPTOR SHEET
CHARGE NEUTRALIZING UNIT
11
DEVELOPING UNIT
12
FINISHED PICTURE
25
26
27
28
30
31
32
33
35
36
37
OPTICAL DENSITY
X-RAY DOSE (MR)
BIAS VOLTAGE SHIELDED REGION
A - INITIAL DISTRIBUTION
B - CONSTANT BIAS VOLTAGE
C - OSCILLATING POSITIVE BIAS VOLTAGE (200-1000 v)
D - LONG EXPOSURE TIME

METHOD AND APPARATUS FOR REDUCING THE DENSITY OF BACKGROUND AREAS WITHOUT AFFECTING THE DENSITY OF PICTURE AREAS IN AN ELECTRON-RADIOGRAPH

BACKGROUND OF THE INVENTION

An electron radiographic system, such as is described in U.S. Pat. No. 3,774,029, "Radiographic System with Xerographic Printing", Muntz et al., utilizes fluid absorption of x-rays to produce an electrostatic image on a receptor sheet of dielectric material. The amount of charge collected on the dielectric receptor is proportional to the x-ray dose. Thus the local charge density on a radiograph depends upon the amount of x-ray absorption which occurs along an x-ray path through the patient and thus varies from point to point.

Development of electronradiography images is accomplished by transporting the dielectric sheet with the latent electrostatic image through a toner in a manner similar to that of xerographic office copiers. However, the liquid toners now used for developing electronradiography images are much more sensitive than commercial office copier toners. The sensitivity of a typical electronradiography toner to x-ray dose is shown in curve A of FIG. 3. The high sensitivity of such toners is partially responsible for the high speed of the electronradiography system as compared to standard screen film combinations. However, as shown in curve A, there is no tendency for electronradiography images to saturate at densities above 2.0, as there is for silver halide film.

Although the high contrast of electronradiography images is an asset at densities below 2.0, it presents difficulties at high densities. The contrast achieved at densities above 2.0. is not entirely useful due to limitations in standard lighting procedures (light boxes) and in effect limits the useful latitude of the electronradiography system. In addition, regions of density greater than 4.0 are difficult to dry and fuse during developing. Thus, the ideal system for electronradiography development would maintain the high gamma of the toners for densities below 2.0, but would produce a decreasing gamma as the dose increases to densities above 2.0.

The usefulness of such a saturation phenomenon is demonstrated by considering the optimum densities for diagnosis for various regions of a standard P.A. chest radiograph. These major regions are shown in the table below:

Average Areas and Densities for P.A. Chest

| | Surface Area ($cm^2$) | Optimum Density (average) | Electrostatic Image Charge Density (n coulomb/$cm^2$) |
|---|---|---|---|
| Background | 100 | ~3.5 | ~33.6 |
| Extraneous (Sides) | 150 | 2.5 | 5.82 |
| Lung Field | 600 | 1.25 | 3.82 |
| Heart, Neck Shoulders | 400 | .45 | 2.02 |
| Spine, Diaphragm | 285 | .15 | .67 |

The high charge density in the background area is due to unattenuated x-rays which have not passed through the patient. This charge density would produce an excessive toner deposit which could spoil the visual image.

Accordingly, it is an object of the present invention to provide new and improved apparatus and method in an electronradiography system for improving the visual image by reducing the charge density in the background area of the latent electrostatic image. A particular object of the invention is to provide for charge density reduction by neutralizing all or a portion of the charge above a predetermined value, so as to achieve a saturation effect.

SUMMARY OF THE INVENTION

The invention utilizes a conventional electronradiography imaging chamber for producing a latent electrostatic image on a dielectric receptor sheet, and also a conventional developing unit for converting the latent image to a visual image. A charge neutralizing step is introduced between the electrostatic image formation step and the developing step, wherein the electrostatic image is exposed to a corona producing ions for neutralizing a portion of the electrostatic charge, with a bias potential provided to limit the neutralization to the relatively high charge density portions of the electrostatic image. The magnitude of the basis potential and the duration of the exposure to the corona determine the characteristics of the resultant visual image. By this means, the excessive charge on the initial electrostatic image is partially or totally neutralized and an optimum density may be obtained without distubing the less highly charged, information carrying areas of the receptor sheet.

DESCRIPTION OF THE PREFERRED EMBODIMENT

Figures 1, 2, 3:
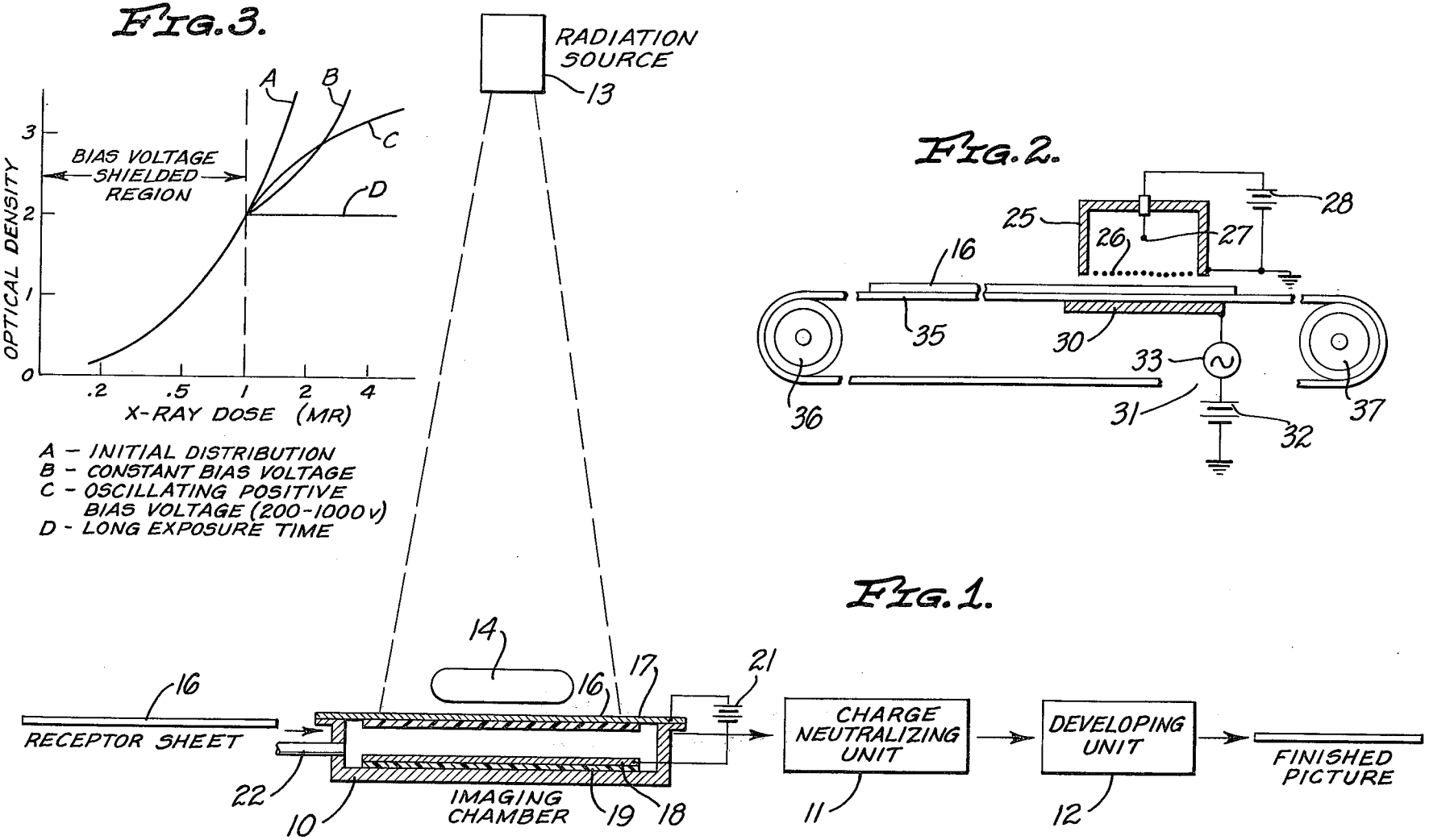
FIG. 1 is a diagram of an electronradiography system incorporating the presently preferred embodiment of the invention.
FIG. 2 illustrates a presently preferred form for the charge neutralizing unit of FIG. 1.
FIG. 3 is a set of curves illustrating the operation of the invention.

The system of the invention includes an imaging chamber 10, a charge neutralizing unit 11, and a developing unit 12. The imaging chamber may be a conventional electronradiography imaging chamber, such as that shown in the aforementioned U.S. Pat. No. 3,774,029. Radiation is directed from a radiation source 13 past the object 14 being imaged, to the chamber 10. A dielectric receptor sheet 16 is carried in the chamber on a cover 17 which serves as one electrode. The other electrode 18 is mounted in the chamber and insulated therefrom by an insulator 19. A voltage source 21 is connected across the electrode 16, 18, and a radiation absorbing fluid such as xenon gas is introduced into the gap between the electrodes via line 22.

The charge neutralizing unit 11 includes a housing 25 with an open bottom, with a plurality of wires 26 mounted in the housing across the open bottom. A typical housing may be 1 inch wide, 1 inch high and fifteen inches long for extending across a 14 by 18 inch receptor sheet. A small diameter wire 27, typically 0.004 inches diameter, is mounted within the housing 25 and electrically insulated therefrom. A high voltage supply 28, typically 6,000 volts d.c. is connected between the housing 25 and the corona wire 27.

An electrical conducting plate 30 is positioned opposite the open side of the housing 25. A bias voltage source 31 is connected to the plate 30, with the voltage on the plate 30 and the voltage on the wire 27 of the same polarity relative to system ground. This polarity is the opposite of the polarity of the electrostatic charge on the receptor sheet produced in the imaging chamber. The bias voltage may comprise a d.c. source 32 and an a.c. source 33 to provide a cyclically varying bias potential. By way of example, the bias voltage may be varied between 220 volts and 2,000 volts at a rate of 60 hertz. In an alternative arrangement, the a.c. component may be omitted and the bias potential maintained constant at 220 volts d.c. The specific magnitude of voltage utilized is not critical, but it is noted that 220 volts is the shielding potential for an optical density of 2.0.

The receptor sheet 16 is positioned between the open side of the housing 25 and the plate 30 and in the embodiment illustrated, means is provided for moving the receptor sheet paste the opening. The sheet 16 may be carried on a belt 35 driven by rolls 36, 37. Typically the belt moves at a rate of about 2 inches per second so that with an opening about 1 inch, the exposure time is less than a second. As will be understood from the following description, the exposure time is one of the parameters affecting the neutralizing operation of the system.

The developing unit 12 may be a conventional xerographic type developer using dry or liquid toner.

In operation, the receptor sheet 16 ordinarily is initially discharged and is then loaded into the imaging chamber. The radiation source is turned on for the desired exposure time, after which the receptor sheet with the latent electrostatic image is passed through the charge neutralizing unit and then through the developing unit, with the finished electronradiograph carrying the visual image coming from the developing unit.

The potential on the wire 27 is sufficient to locally ionize the surrounding air. With the potential on the wire being the opposite polarity to that of the electrostatic charge on the receptor 16, the ions produced will have the opposite polarity of the electrostatic image. With the housing 25 and grid wires 26 at ground potential, the field between the electrostatic image on the receptor 16 and the grid wires 26 is determined only by the image charge density and the potential on the bias plate 30.

For the case of an electrostatic image of negative charge, the voltage applied to the bias plate 30 artifically shifts the zero potential point of the electrostatic image making relatively low charge density areas appear positive. These positive appearing areas repel the positive ions produced by the corona wire 27 and thus are not neutralized by the ions. However, those areas of the electrostatic image which have a relatively high charge density, such as the background area, are not shifted to positive and thus create an attractive field between the electrostatic image and the grid wires. Thus the positive ions are attracted to the receptor sheet and neutralize or partially neutralize the negative electrostatic image. The operation will of course be the same with a positive electrostatic image and negative corona wire and bias potential.

Several modes of operation have been tested and a combination of techniques appears to give the best results. The degree of neutralization which occurs depends upon several parameters; the ion current generated by the corona wire, the spacing between the ground grid and the image surface, the time the image is exposed to the corona, and the bias voltage. The degree of neutralization of the negative electrostatic image with voltage above the bias voltage can be varied from only a few percent to complete truncation of all signal above the bias voltage. Thus one can tailor the shape of the H & D curve at the upper range of density to suit the needs of the radiologists.

Three possible shapes, B, C, and D, are shown in FIG. 3. Curve A shows the initial H & D for liquid toner development. For all cases the positive bias voltage was set to shield all image charge below the optical density 2.0 level. However this cutoff level can be adjusted up or down depending upon the needs of the radiologists. Curve B shows time dependent operation with a constant bias voltage and one setting of corona current and image grid spacing. Curve C is for a slightly higher corona current but has a bias voltage which varies at 60 Hz between approximately 220 volts and 2000 volts. A complete truncation can occur by long exposure times and high corona current. This phenomenon is shown in curve D.

The presently preferred mode of operation is to utilize the oscillating bias potential and obtain a proportional saturation as shown in curve C. This mode provides a wide latitude for the electronradiographic images, while avoiding excessive toner deposits in the background area. While the optical density of the background area is reduced with the method and apparatus of the invention, the resolution is not degraded and the information content of the image is not disturbed.

We claim:

1. In an electronradiography system, the combination of:

an imaging chamber having first and second spacedelectrodes with a gap therebetween and means for positioning a dielectric receptor sheet in the gap at one of said electrodes during an exposure for producing a latent electrostatic image on said sheet with a relatively high charge density in the background area and a relatively low charge density in the picture area;

a charge neutralizing unit having a corona generating unit, a bias conductor, means for positioning said receptor sheet with latent electrostatic charge between said corona unit and bias conductor with the surface of said sheet carrying said charge facing and spaced from said corona unit, and means for connecting a bias voltage source between said corona unit and bias conductor, so that the magnitude of said relatively high charge density is reduced without reducing the magnitude of said relatively low charge density; and a developer unit for receiving said receptor sheet with reduced charge density and developing said latent electrostatic image into a visual image.

2. A system as defined in claim 1 wherein said corona generating unit has an elongate output with wire grid, and including means for moving said receptor sheet past said opening.

3. A system as defined in claim 1 including a d.c. supply connected as said bias voltage source.

4. A system as defined in claim 1 including a cyclically varying supply connected as said bias voltage source.

5. In a method of making an electronradiograph, the steps of:

generating a latent electrostatic image on a dielectric receptor sheet by exposing the sheet in an imaging chamber to a radiation source with the object to be imaged between the radiation source and the imaging chamber and with the resultant electrostatic image having a relatively high charge density in the background area and a relatively low charge density in the picture area;

after generating the latent image, exposing the receptor sheet with latent electrostatic image to an ion discharge while maintaining the receptor sheet spaced from the ion source and at a bias potential so that ions are attracted to areas of the electrostatic image of higher charge density as determined by the magnitude of the bias potential and partially neutralize the electrostatic image in the relatively high charge density background area without reducing the magnitude of the relatively low charge density in the picture area; and then developing the electrostatic image into a visual image by toner particles attracted to the electrostatic image.

6. The method of claim 5 including maintaining the bias potential substantially constant during the ion exposing step.

7. The method of claim 5 including cyclically varying the bias potential during the ion exposing step.

8. The method of claim 5 including initially discharging the receptor sheet prior to generating the latent electrostatic image.

9. The method of claim 5 wherein the electrostatic image is negative and the ions and bias potential are positive.

10. The method of claim 5 wherein the electrostatic image is positive and the ions and bias potential are negative.

* * * * *

UNITED STATES PATENT AND TRADEMARK OFFICE

CERTIFICATE OF CORRECTION

PATENT NO. : 3,949,222

DATED : April 6, 1976

INVENTOR(S) : John H. Lewis

It is certified that error appears in the above-identified patent and that said Letters Patent are hereby corrected as shown below:

Column 2, Line 22 "basis" should be --bias--
Line 26 "distubing" should be --disturbing--

Column 3, Line 17 "paste" should be --past--

Column 4, Line 32 "spacede-" should be --spaced e- --
Line 63 "electronradiograph" should be --electron radiograph--

Signed and Sealed this

Tenth Day of August 1976

[SEAL]

*Attest:*

RUTH C. MASON
*Attesting Officer*

C. MARSHALL DANN
*Commissioner of Patents and Trademarks*